US008336809B2

(12) United States Patent
Muren

(10) Patent No.: US 8,336,809 B2
(45) Date of Patent: Dec. 25, 2012

(54) SYSTEM FOR CONTROLLING FLIGHT DIRECTION

(75) Inventor: Petter Muren, Nesbru (NO)

(73) Assignee: Proxflyer AS, Nesbru (NO)

( * ) Notice: Subject to any disclaimer, the term of this patent is extended or adjusted under 35 U.S.C. 154(b) by 878 days.

(21) Appl. No.: 11/852,341

(22) Filed: Sep. 10, 2007

(65) Prior Publication Data

US 2008/0191100 A1 Aug. 14, 2008

(30) Foreign Application Priority Data

Feb. 13, 2007 (NO) ..... 20070810

(51) Int. Cl.

| | |
|---|---|
| ***B64C 33/02*** | (2006.01) |
| ***B64C 3/38*** | (2006.01) |
| ***A63H 27/28*** | (2006.01) |
| ***A63H 27/00*** | (2006.01) |

(52) U.S. Cl. ..... 244/22; 244/48; 446/35; 446/61

(58) Field of Classification Search ..... 244/22, 244/48, 72, 11; 446/35, 61, 66

See application file for complete search history.

(56) References Cited

U.S. PATENT DOCUMENTS

| | | | | |
|---|---|---|---|---|
| 1,450,480 | A | 4/1923 | Buck | |
| 1,856,093 | A * | 5/1932 | Ford et al. | 244/48 |
| 2,430,793 | A * | 11/1947 | Wells | 244/87 |
| 2,504,767 | A * | 4/1950 | Wallis | 244/46 |
| 2,788,182 | A * | 4/1957 | Tobin et al. | 244/48 |
| 2,985,408 | A * | 5/1961 | Johnson | 244/48 |
| 4,415,132 | A * | 11/1983 | Shirk | 244/48 |
| 5,280,863 | A * | 1/1994 | Schmittle | 244/48 |
| 5,918,832 | A * | 7/1999 | Zerweckh | 244/48 |
| 6,082,671 | A * | 7/2000 | Michelson | 244/72 |
| 6,264,136 | B1 * | 7/2001 | Weston | 244/48 |
| 6,550,716 | B1 | 4/2003 | Kim et al. | |
| 6,612,893 | B2 | 9/2003 | Rehkemper et al. | |
| 6,938,853 | B2 * | 9/2005 | Pines et al. | 244/11 |
| 7,121,505 | B2 * | 10/2006 | Chronister | 244/75.1 |
| 2004/0155145 | A1 | 8/2004 | Ohta | |
| 2004/0169485 | A1 | 9/2004 | Clancy | |
| 2005/0269447 | A1 * | 12/2005 | Chronister | 244/72 |

FOREIGN PATENT DOCUMENTS

| | | |
|---|---|---|
| FR | 2292878 A * | 7/1976 |
| GB | 20145 | 0/1911 |
| GB | 442667 | 6/1935 |

OTHER PUBLICATIONS

EPO Written opinion dated Jul. 1, 2008.
Chen Guodong et al "The development of minitype aerocraft", Robot Technology and Application, Dec. 31, 2006.
Office Action dated Jun. 5, 2009 Chinese Patent Office , citing inter alia Chen Guodong.

* cited by examiner

*Primary Examiner* — Joseph W Sanderson
(74) *Attorney, Agent, or Firm* — Christian D. Abel

(57) ABSTRACT

An aircraft that is enabled to turn in a desired direction, and a method for controlling the flight direction of an aircraft, by employing differential drag on the respective wings. A control means that receives a control signal indicating a left turn increases the incidence angle on the left wing and reduces it on the right wing. For a right turn the opposite action is performed. The aircraft comprises airfoils that have increased drag as the incidence angle increases but have a generally constant lift.

11 Claims, 4 Drawing Sheets

SYSTEM FOR CONTROLLING FLIGHT DIRECTION

FIELD OF THE INVENTION

The present invention relates to fixed wing aircrafts such as gliders and propeller driven airplanes and to flapping wing aircrafts such as ornithopters. In particular it relates to means and methods for controlling the flight direction of such aircrafts.

BACKGROUND OF THE INVENTION

Typically, ailerons and an elevator control the flight direction of airplanes. Ailerons are normally a part of the trailing edge, the aft part of the wing, which is hinged so it can tilt up and down. When the aileron is tilted down it alters the shape of the wing and in effect increases the incidence angle and the angle of attack and thereby also the lift on that wing. When the aileron is tilted down on one wing it is always tilted up on the opposite wing and thereby reducing the lift on this wing.

The incidence angle is the angle between the cord line of the wing and the longitudinal axis of the aircraft itself. The angle of attack is on the other hand defined as the angle between the cord line and the direction of the airflow. If we change the incidence angle and keep everything else unchanged, it can be appreciated that the angle of attack is changed by the same amount. However, changing the attitude of the aircraft by e.g. pulling the nose up, will change the angle of attack while the incidence angle remains unchanged.

The ailerons control the roll, the banking, of the airplane while the elevator controls the pitch, the up-down direction of flight. The elevator is typically placed at the trailing edge of the stabilizer at the rear end of the airplane and by tilting it up or down it alters the lift force on the stabilizer and thereby controls the up and down direction.

To control the flight direction; the ailerons are used to bank the airplane sideways and by applying a little up-elevator the airplane performs a turn while it keeps its height in the air.

For a slow flying aircraft the ailerons can have less effect and especially on single propeller airplanes it is possible to instead use the rudder to control the flight direction. The rudder is placed vertically at the tail of the airplane and controls the yaw.

Single propeller airplanes normally have the propeller placed in the front, creating a fast airflow over the stabilizer, elevator and rudder. Twin-engine airplanes, very slow flying gliders or flapping wing aircrafts like ornithopters, however, lack the additional airflow over the stabilizers and rudder that single propeller aircrafts normally have. For these kinds of aircrafts it can be more difficult to get a good directional control.

One way of overcoming this problem is in the case of a twin-engine airplane to use differential thrust. Each of the two motors, jet engines or propellers which typically are placed one on each wing, can be controlled individually. By increasing the speed of one motor and reducing the speed of the opposite motor the flight direction can be controlled. This is a well-known way of controlling a twin-engine airplane and it is described in e.g. U.S. Pat. No. 6,612,893.

In the case of ornithopters the forward thrust is produced by the flapping wings and not by propellers. If the ornithopter in addition flies slowly, a normal rudder at the back of the aircraft has reduced effect. One way of trying to solve this problem is to make the whole tail movable. This solution is shown in e.g. U.S. Pat. No. 6,550,716. Here the whole tail is hinged and controlled by servos. This solution is believed to be both fragile and complicated.

A simpler way of controlling slow flying small aircrafts, like remotely controlled toy airplanes or slow flying ornithopters is to use a small vertically placed propeller instead of the rudder at the rear end of the aircraft. This method is described in US patent application US 20040169485. The small propeller can blow air to either left or right and thereby pushes the tail sideways to control the flight direction. However, when the aircraft turns e.g. to the left it normally also banks or rolls over to the left. In this position the tail is pushed up by the blowing tail propeller and the effect of this is almost like having a down-elevator action forcing the aircraft into a downwardly turn instead of a gentle turn where the height is kept. This tendency makes it more difficult to perform tight maneuvers with this system.

Especially for slowly flying aircraft with high angles of attack and for flapping wing aircrafts the existing systems have limitations. Some of the ways for controlling the flight direction described above are both innovative and simple but it is believed that an even simpler and better system is possible.

SUMMARY OF THE INVENTION

The present invention aims at fulfilling the need for a very simple and low cost way of controlling the flight direction of an aircraft flying slowly or with a high angle of attack by changing the incidence angles of its wings. Furthermore such control means could be used to control a slow flying flapping wing aircraft.

A control means that receives a control signal indicating a left turn increases the incidence angle and thereby also the angle of attack on the left wing and reduces it on the right wing. For a right turn the opposite action is performed. An aircraft that utilizes the current invention for directional control will benefit from having airfoils (e.g. flat plates) that experiences increased drag as the angle of attack increases but have a generally constant lift at high and increasing angles of attack.

Normally an aircraft depends on changes in the lift on its wings to control the flight direction. The current invention, however, is able to manoeuvre mainly due to drag differences on the wings. To perform controlled manoeuvres the wings incidence angles are changed in the opposite direction of what is normal on all other airplanes.

Finally different means for controlling the incidence angles and thereby the angles of attack on fixed and flapping wings according to the present invention are briefly discussed.

BRIEF DESCRIPTION OF THE DRAWINGS

The following detailed description of the preferred embodiment is accompanied by drawings in order to make it more readily understandable. In the drawings.

DETAILED DESCRIPTION OF THE PREFERRED EMBODIMENT

In the following the present invention will be discussed and the preferred embodiment described by referring to the accompanying drawings. Alternative embodiments will also be discussed, however, people skilled in the art will realize other applications and modifications within the scope of the invention as defined in the enclosed independent claims.

Figure 1:
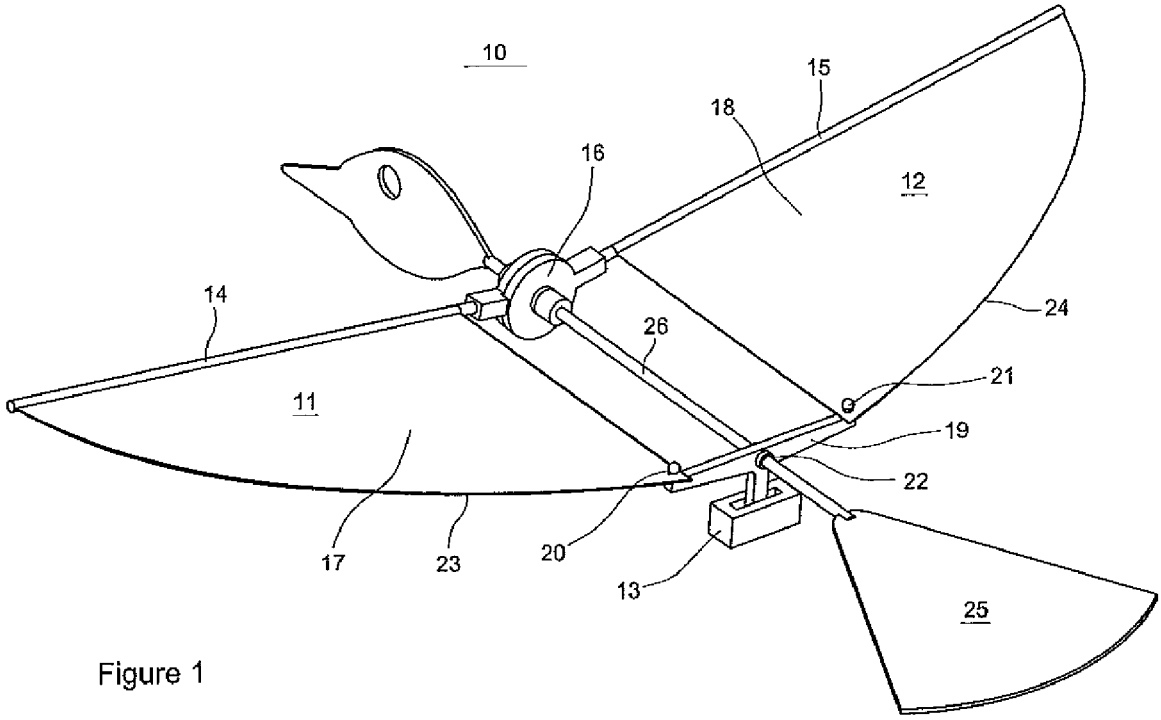
FIG. 1 is a perspective view of a flapping wing aircraft with a teetering control means for changing the incidence angle of the wings.

In FIG. 1 the preferred embodiment of an aircraft (10) according to the present invention is shown. It is a flapping wing aircraft, an ornithopter, utilizing a control means to control the flight direction. The present invention aims at fulfilling the need for a very simple, low cost and effective way of controlling the flight direction of an aircraft flying slowly or with a high angle of attack.

Normally an aircraft depends on changes in the lift on its wings to control the flight direction. Utilizing the current invention it is, however, possible to manoeuvre mainly based on drag differences between the left and right wings. To perform controlled manoeuvres the wings' incidence angles are changed, but they are changed in the opposite direction of what is normally seen on all other airplanes. How this is possible is described in detail later.

For the sake of this description and as used in the claims, lift is a force acting perpendicular to the direction of flight sustaining the aircraft in the air. Lift can be generated by the wings or by the thrust from a propeller/rotor having a vertical force component. Drag on the other hand, is a force acting in the opposite direction of flight, slowing down the aircraft. A major part of the drag acts upon the wings.

For clarity, the ornithopter (10) is shown as a principal sketch and all electronics, power sources and control wires, as well as the body of the ornithopter are or are not shown. The ornithopter (10) has an internal frame or a rod (26) going from the head back to the generally horizontal tail (25). The rod (26) is parallel to the longitudinal axis of the aircraft and it holds the flapping mechanism (16), which is positioned just behind the head of the ornithopter.

The ornithopter (10) is a radio controlled electric flying toy and in addition to what is shown and described, there will also be batteries, control electronics including driving circuits and an electric motor for powering the flapping mechanism (16). Rods (14,15) are mounted to the flapping mechanism (16) to create the wing spars and leading edges of the wings (11,12). One rod (14) is extending out to the left, perpendicular to the internal frame (26) and the other rod (15) is extending out to the right. They are both mounted to the flapping mechanism (16) with a nominal angle in the vertical plane to give the wings a dihedral for better stability. The result of this is that when the flapping mechanism (16) moves the tip of the wings (11,12) up and down they will have its lower position just below the horizontal plane while the upper position is close to a 45 degrees angle.

The major part of the wings (11,12) is made of a thin flexible material (17,18). The flexible material (17,18) is cut out to give the wings (11,12) a tapered shape with a straight leading edge and a curved trailing edge (23,24). The cord lines of the wings are longest in the inner end, closest to the centre line. Along its leading edge the flexible material (17, 18) is attached to the straight rods (14,15) that are mounted to the flapping mechanism (16).

To control the ornithopter (10) the inner end of the wings (11,12) are at a point close to their trailing edges (23,24) connected to a control means. The control means comprises a force-transmitting member, a generally horizontal rocker arm (19), that is pivotally connected (22) to the internal frame (26), enabling the arm (19) to tilt up and down, teeter, about the pivot point (22). At each end of the rocker arm (19) there are connecting points (20,21) where the wings are connected to the rocker arm. From the midpoint of the rocker arm (19) a vertical member is extending down into the lower part of the control means. In the lower part of the control means an actuator (13) is used to move the vertical member from side to side. This movement generated in the lower part of the control means causes the rocker arm (19) to teeter and thereby can e.g. the left connecting point (20) be moved down while the right connecting point (21) is moved up. Since the wings (11,12) are flexible mounted (via the flexible wing material) to the rods at the leading edge and since they are connected to the connecting points (20,21) their average incidence angles (and therefore also their average angles of attack) will be changed as the rocker arm (19) teeters. The direction and force of the movements are linked to an input, a control signal (not shown), driving or setting the actuator (13) in the correct position.

Different technical solutions for the control means, the actuator and the force-transmitting member are shown in FIG. 4 to 7 and are described later.

Figure 2A:
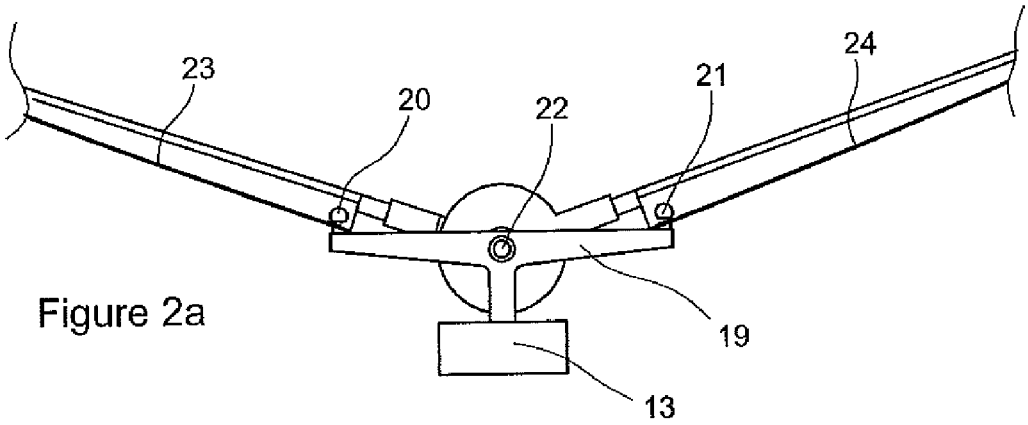
FIGS. 2*a* and 2*b* is rear views of the aircraft in FIG. 1 showing the control means in a neutral position and in a right-turning position.
Figure 2B:
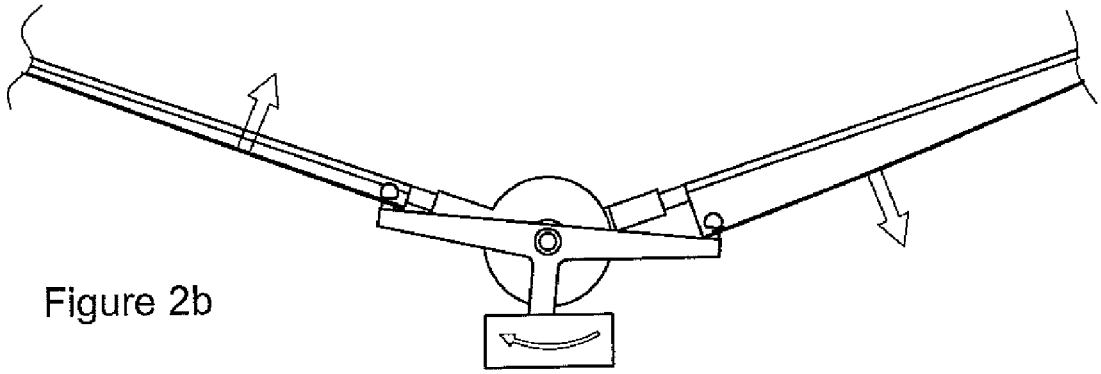
Figure 3:
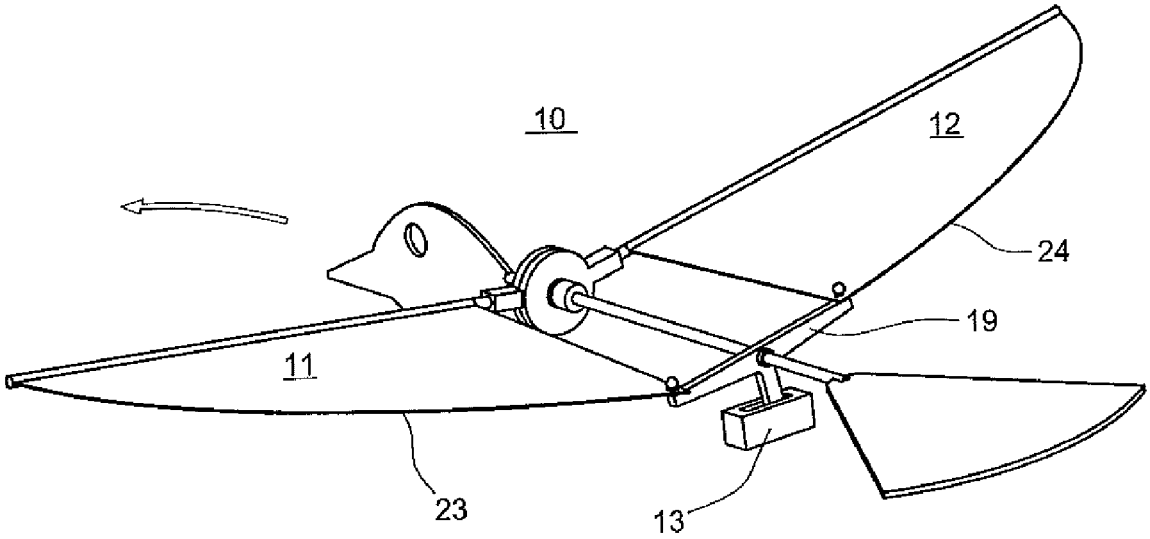
FIG. 3 is a perspective view of the aircraft in FIG. 1 turning to the left.

FIGS. 2 and 3 show how the actuator (13) and the rocker arm (19) change the average incidence angles of the wings on the ornithopter (10) to control the direction of flight. In FIG. 2*a* the rocker arm (19) is horizontal and both wings have the same incidence angle. The ornithopter is flying straight forward. In FIG. 2*b*, however, the rocker arm (19) is tilted to the right. Now the left connecting point (20) is moved up and the right connecting point (21) is moved down. Since the wings are connected to these points (20,21) we can appreciate that the trailing edge (23) of the left wing will be moved up causing the incidence angle and the angle of attack on the left wing (11) to be reduced wile the trailing edge (24) of the right wing (12) will be moved down and thereby increasing the incidence angle and the angle of attack on the right wing (12). This causes the ornithopter to turn to the right. FIG. 3 shows the opposite situation with the trailing edge (23) of the left wing moved down and the trailing edge (24) of the right wing moved up. Now the ornithopter (10) turns to the left.

It is important to notice that the changes in incidence angles used to control aircrafts according to the present invention is the opposite of what is normally used to control the flight direction on aircrafts that fly faster or with lower angles of attack. It is drag-differences due to changed angles of attack and not lift-differences that initiate a change in the flight direction. This is the main feature of the present invention.

Furthermore this way of controlling an aircraft can be used for ornithopters with flapping wings as well as for gliders and other slow flying aircrafts. Because the wings of a flapping wing aircraft are flexible the incidence angles will vary over the wingspan and during the wing-strokes. The drag and lift acting on such wings are mainly linked to the average angle of attack over the wing. The aircraft shown in FIGS. 8*a* and 8*b* have rigid wings and airfoils like thin plates. The wings are pivotable mounted to the rest of the aircraft. When these wings rotate about their pivoting axis (not shown) their respective incidence angles changes (A1 to A2, B1 to B2). When the incidence angles are changed the angles of attack are also changed in the same direction.

It will be appreciated that this control principle also functions if only parts of the wings have changing incidence angles. The same result can be achieved if the wings consist of e.g. two parts, a rigid part mounted to the aircraft and a moving part pivotable connected to the rigid part. When the angle of the movable part is altered the average incidence angle (and angle of attack) on the whole wing will be changed.

All aircrafts experience an effect called adverse yaw when they use their ailerons to initiate a turn. To turn to the right the aileron on the left wing is moved down, locally increasing the average angle of attack on the left wing while the aileron on the right wing is moved up, locally reducing the average angle of attack on the right wing. On an ordinary airplane having normal airfoils these changes in the incidence angles causes the lift on the left wing to increase significantly and the lift on the right wing to be reduced. This difference in lift initiates a right turn. However, another effect is also present: The increased average angle of attack on the left wing causes the drag on that wing to increase while the drag on the right wing is reduced. This difference in drag force acting on the wings tries to yaw the aircraft to the left while it banks is to the right. This effect is called adverse yaw. On all aircrafts this is a totally unwanted effect and must be compensated for by the use of the rudder or by other means trying to reduce the drag differences.

Figure 8A:
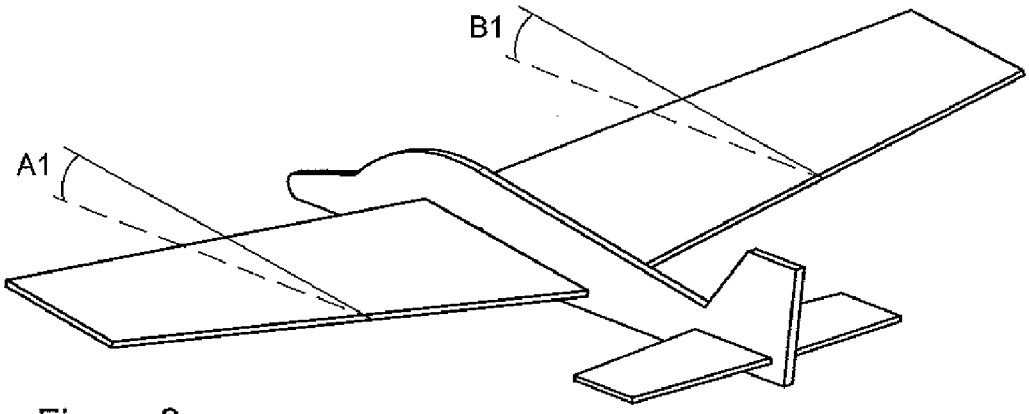
FIGS. 8*a* and 8*b* are perspective views of an aircraft; the incidence angles are shown in a neutral and in a turning situation.
Figure 8B:
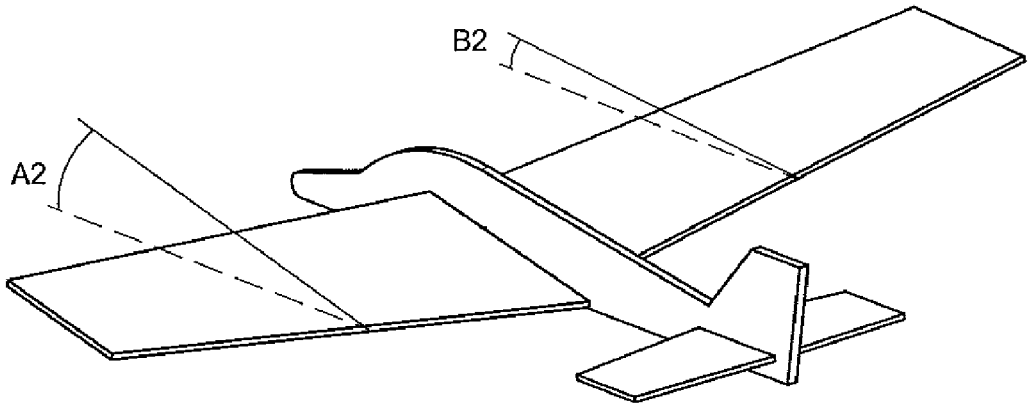
Figure 9:
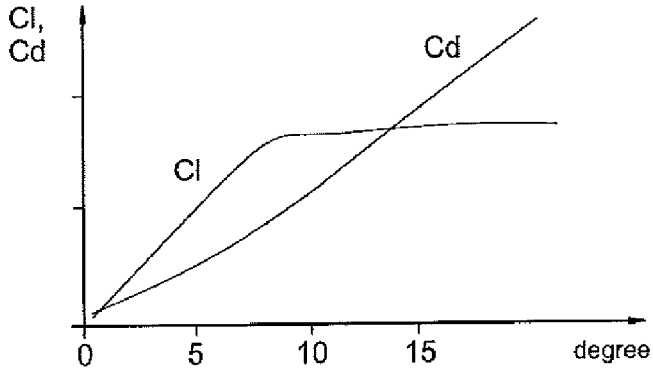
FIG. 9 is a diagram showing drag coefficients (Cd) and lift coefficients (Cl) for a flat plate airfoil.

To describe how the present invention is used to control the flight direction we can turn to FIGS. 8 and 9. If we can utilize the increased drag on the wing that gets an increased angle of attack without also substantially increasing the lift, we could control the direction of flight. In FIGS. 8*a* and 8*b* an airplane with flat plate wings is shown. If we also look at the diagram in FIG. 9 showing typical graphs for lift and drag coefficients for a cross-section of a flat plate as a function of angle of attack, we can see that these wings does not stall like ordinary wings with proper airfoils. The lift coefficient (Cl) increases as the angle of attack increases from zero and up, however, we do not see a sudden and significant drop in the lift (stall) as the angle of attack continues to increase. Instead, when the angle of attack is high enough we can continue to change the angle of attack without substantially altering the lift.

An airfoil can be defined as the shape of a wing as seen in cross-section. Many shapes, such as a flat plate set at an angle to the flow, will produce lift. However, lift generated by most shapes will be very inefficient and create a great deal of drag. One of the primary goals of airfoil design is to devise a shape that produces the most lift while producing the least drag. For almost all airfoils the graphs for section lift coefficient vs. angle of attack follow the same general shape, but the particular numbers will vary. The graphs shows an almost linear increase in lift coefficient with increasing angle of attack, up to a maximum point, after which the lift coefficient falls away rapidly. The airfoil is now in stall. In aerodynamics, a stall is a sudden reduction in the lift forces generated by an airfoil and occurs when a "critical angle of attack", the stall angle, for the airfoil is exceeded.

Stalling is an unwanted effect, but during normal flight in an ordinary airplane it causes no immediate problems. Normally the airfoil of the wing has an angle of attack well below the stall angle. The positive effects the airfoil has on lift and drag efficiency more than outweighs the stall behavior.

In the present invention, however, we need wings and airfoils that do not show a typical stall behavior. For the sake of this description and as used in the independent claims a "lift-preserving airfoil" is defined. A wing employing such lift-preserving airfoils is characterized by:

- Lift that increases as the angle of attack increases from zero and up, without having a sudden and significant drop in the lift as the angle of attack continues to increase.
- At high angles of attack, a continued increase in the angle of attack will not substantially alter the lift.
- Drag that increases continuously as the angle of attack increases from zero and up.

Examples of such lift-preserving airfoils are flat plates, very thin airfoils with a sharp leading edge, special airfoils with a large step or hole in the top surface. These airfoils are normally not used in any aircrafts because their lift and drag efficiency is not very good, however, they may be used in the wings of an aircraft utilizing the present invention to control the flight direction.

Another example on lift-preserving airfoils is the thin and flexible airfoil typically used in some flapping wing aircrafts, including the airfoil described in the preferred embodiment of the present invention. It is believed that the flexibility of such airfoils and the fact that they change in shape during the wing strokes contributes to suppressing stall and allows the angle of attack to be increased without experiencing a significant drop in the lift.

If we have an aircraft, a fixed wing glider or an ornithopter with such lift-preserving airfoils (and where the lift generated by these airfoils contributes a major part of a total vertical force needed to sustain flight, as opposed to an aircraft hanging by the thrust from its propeller), we can appreciate that when we fly at an angle of attack close to or in the region where the lift is not substantially increasing, a further increase in the angle of attack on one of the wings will not lead to a substantially increase in the lift on that wing. If the lift had increased, this would have caused the aircraft to bank and initiate a turn in the opposite direction of what we intended.

When we then look at the drag, we will see that it increases continuously as the angle of attack increases. Since the incidence angle and the angle of attack is closely linked we can now appreciate that the airplane in FIG. 8*b* will, since it flies with a high angle of attack, have about the same lift on both wings even if the incidence angle (A2) on the left wing is larger than the incidence angle (B2) on the right wing. The drag will, however, be higher on the left wing than on the right wing and the aircraft will turn to the left—completely opposite of what one would normally expect.

There are several other factor influencing on the aircrafts described in the present invention but the differences in drag is believed to be the most important factor enabling this new way of controlling the flight direction.

For anyone skilled in the art it will be obvious that an aircraft, fixed wing or flapping wing, equipped with more than one set of wings also can benefit from utilizing the present invention to control the flight direction. E.g. and ornithopter with two left wings and two right wings, the wings within each pair flapping in opposite direction, may very well have a control device for adjusting the incidence angles of the wings in order to control the direction of flight. On the other hand, changing the incidence angle on only one wing on an aircraft having one or more additional fixed wings could also be used to control the flight direction.

In FIGS. 4, 5, 6 and 7 different devices for changing the incidence angles are shown.

Figure 4:
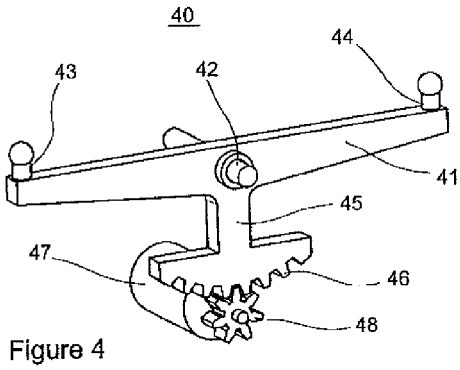
FIG. 4 is a perspective view of a control device comprising gears and a motor.

In FIG. 4, the preferred embodiment of the present invention (40), utilizing a motor actuator, for example an electric motor actuator, and gears is shown. A force-transmitting member, a generally horizontal rocker arm, (41) is pivotally connected (42) to a shaft enabling the arm (41) to tilt up and down, teeter about the shaft. At each end of the arm (41) there is a connecting point (43,44) used to mount or connect the inner aft part of the wings to the rocker arm (41). From the midpoint of the rocker arm (41) a vertical arm (45) is extending down ending in a gear segment (46). An actuator in the form of a motor (47) with a small gear (48) is placed below the gear segment (46) and is acting together with the gear segment (46) so that when the motor (47) rotates, the rocker arm (41) teeters and thereby can e.g. the left connecting point (43) be moved down while the right connecting point (44) is moved up. Since the wings are connected to the connecting points (43,44) their incidence angles will be changed in opposite directions as the rocker arm (41) teeters. The motor (47) will run just a few turns in each direction, depending on the gear ratio. The direction and force of the movements are linked to an input signal (not shown) driving the motor.

If the vertical arm (45) was positioned off centre or had a different shape, the gear segment (46) could be placed below the small gear (48) with the teeth facing upwards. This is a somewhat more complicated design but it has the advantage that the gear ratio will be higher enabling a higher force to be transmitted trough the rocker arm (41).

Figure 5:
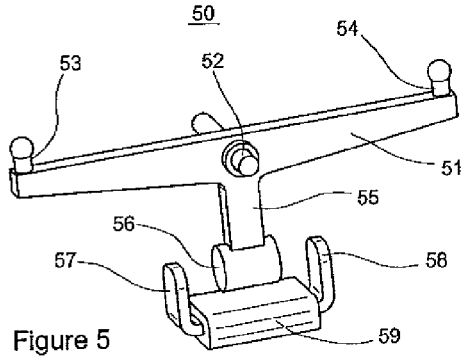
FIG. 5 is a perspective view of a control device comprising a permanent magnet and a U-shaped electro magnet.

In FIG. 5, a control device (50) utilizing a U-shaped electro magnet actuator is shown. A generally horizontal rocker arm (51) is pivotally connected (52) to a shaft enabling the arm (51) to tilt up and down, teeter about the shaft. At each end of the arm (51) there is a connecting point (53,54) used to mount or connect the inner aft part of the wings to the rocker arm (51). From the midpoint of the rocker arm (51) a vertical arm (55) is extending down ending in a permanent magnet (56). An U-shaped electro magnet (59) with left (57) and right (58) iron poles is placed below the permanent magnet (56) and is acting together with the permanent magnet (56) so that when the electro magnet (59) is activated the permanent magnet (56) and the arm (55) is pulled against e.g. the left pole (57). This teeters the rocker arm (51) and thereby can the incidence angles of the wings be controlled in the same way as described above for the motor actuator (40). The direction and force of the movements are linked to an input signal (not shown) driving the electro magnet (59).

Figure 6:
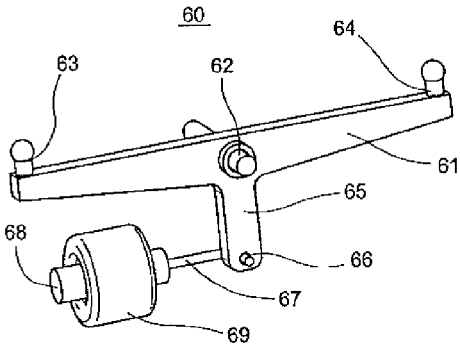
FIG. 6 is a perspective view of a control device comprising a link arm, a permanent magnet and an electro magnetic coil.

In FIG. 6, a control device (60) with an actuator utilizing a circular coil magnet is shown. A generally horizontal rocker arm (61) is pivotally connected (62) to a shaft enabling the arm (61) to tilt up and down, teeter about the shaft. At each end of the arm (61) there is a connecting point (63,64) used to mount or connect the inner aft part of the wings to the rocker arm (61). From the midpoint of the rocker arm (61) a vertical arm (65) is extending down and at the end it is equipped with a hole (66). A generally horizontal member, a link arm, (67) is mounted in the hole (66) and extends out to the left where it is connected to a permanent magnet (68). The permanent magnet (68) is positioned inside a circular coil and together with the link arm (67) it is free to move sideways. When the coil (69) is activated the permanent magnet (68), the link arm (67) and the vertical arm (65) is pulled to e.g. the left. This teeters the rocker arm (61) and thereby can the incidence angles of the wings be controlled in the same way as described above (40). The direction and force of the movements are linked to a input signal (not shown) driving the coil (69).

Other kinds of electronic actuators can be adapted to control the incidence angle of a wing. A piezoelectric actuator can very well replace the magnetic coil (69) and magnet (68) in the embodiments shown in FIG. 6. Another alternative is to use piezoelectric material in the rocker arm (61) itself. The inner parts of the arm can be replaces with a piezoelectric element, while the outer parts of the arm have the original connecting points (63,64) and transmit the force to the wings. The pivot point (62) is not used and the rocker arm is in stead fixed to the aircraft. When the piezoelectric material bends in response to an electric input the outer parts of the arm and the connecting points (63,64) acts as force-transmitting members moving the wing up or down.

Figure 7:
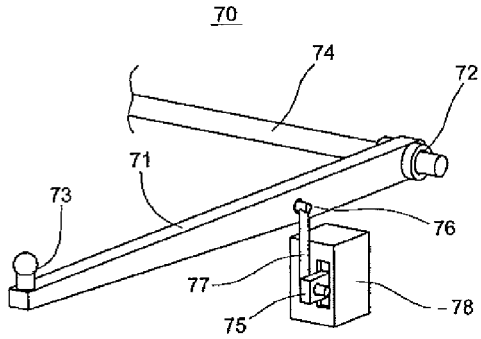
FIG. 7 is a perspective view of a control device comprising an arm pivoting around a wing spar, a link arm and a servo.

In FIG. 7, a control device (70) utilizing a servo is shown. A generally horizontal force-transmitting arm (71) is positioned in the longitudinal direction of the aircraft. At its foremost point it is pivotally connected (72) to a shaft enabling the aft part of the arm (71) to tilt up and down. At the aft end of the arm (71) there is a connecting point (73) used to mount or connect the inner aft part of one wing to the arm (71). A hole (76) is placed on the arm (71). A second force-transmitting member, a vertical link arm (77), is mounted in the hole (76) and is extending down. At the lower end, the link arm (77) is connected to a servo arm (75) on a servo (78). When the servo arm (75) is moving it causes the arm (71) and the connecting point (73) to move up or down and thereby can the incidence angle of one of the wings be controlled. The direction and force of the movement is linked to an input signal (not shown) driving the servo (78). One control device (70) changes the incidence angle of only one wing. With a minimum of adjustments this control means (70) can be an integrated part of a flapping wing so that the trailing edge of the wing does not need to be directly connected to the body of the aircraft.

Another alternative use of the embodiment shown in FIG. 7 is in case of a fixed wing aircraft. In this embodiment the connecting point (73) will not be used, but in stead the arm (71) is directly connected to the wing itself or it can be an integrated part of the wing. When the force from the servo is transmitted to the wing via the vertical link arm (77) the wing is moved up or down causing the incidence angle of the otherwise fixed wing to be changed. It will be obvious to anyone skilled in the art that the same system can also be used to control the angle of only a part of the wing, this part being pivotable connected to the rest of the wing.

FIG. 7 can furthermore be used to illustrate how the flight direction, or more correctly the rate and direction of a turn, can be manually set before the flight starts. If the servo (78) acts like a friction element, a retaining or holding force is transmitted via the vertical link arm (77) to the arm (71) holding it in one position as long as there is no manual input. The input controlling the incidence angle will now be a manual force, setting or adjusting the position of the arm and thereby also the incidence angle of the wing. The arm (71) holds the wing in position when there is no input and moves the inner part of the wing up or down in response to a manual force applied to its aft most end. The friction in the servo (78) is large enough to hold the arm (71) in position during flight but low enough to be overcome by a manual input.

If the actuator (motor) in FIG. 4 was a mechanical friction element acting against the teeth in the lower part of the rocker arm this embodiment could also function as a manual input device. By manually tilting the rocker arm, the new turn rate can be set. The motor could also very well be replaced by a pointed spring member resting between the teeth, allowing for a stepwise adjustment of the rocker arm position. If the rocker arm is equipped with a vertical member extending up over the wings, this member can be used as a finger grip for easy manual adjustments.

While the preferred embodiment of the present invention have been described and certain alternatives suggested, it will be recognized by people skilled in the art that other changes may be made to the embodiments of the invention without departing from the broad, inventive concepts thereof. It should be understood, therefore, that the invention is not limited to the particular embodiments disclosed but covers any modifications which are within the scope and spirit of the invention as defined in the enclosed independent claims.

The invention claimed is:

1. A winged aircraft that is enabled to turn in a desired direction by utilizing differential drag acting upon the wings, said aircraft comprising:

a left wing and a right wing each having a first average angle of attack with a first initial drag state, wherein at least a part of said wings is movable in a first and a second direction such that movement of said part in the first direction positively changes the average angle of attack to achieve a second state of increased drag and movement of said part in the second direction negatively changes the average angle of attack to achieve a third state of decreased drag, a force-transmitting member that is controlled by a left or right turning input, said force-transmitting member being operatively connected to said part of the wings, arranged to at least move said part of the left wing in said first direction or said part of the right wing in said second direction in response to a left turning input, and at least move said part of the right wing in said first direction or said part of the left wing in said second direction in response to a right turning input, said left and right wings are arranged with a large enough average angle of attack such that changes in the average angles of attack alters the drag acting upon the wings without also substantially altering the lift, wherein said left and right wings are flapping wings that comprise a rigid leading edge and a flexible skin mounted to said rigid leading edge, whereby, changing the average angle of attack on at least one of the wings to a state where the left wing and the right wing have different average angles of attack will result in different drag acting upon the respective wings, the wing having the greater average angle of attack also having the greater drag, thereby turning the aircraft in the direction of the wing having the greater average angle of attack.

2. An aircraft according to claim 1 wherein said force-transmitting member is a moveable linkage arranged to move said part of the wings in response to a force.

3. An aircraft according to claim 2 wherein said linkage is a rocker arm pivotably mounted to the aircraft, said rocker arm being connected to at least one of the wings, movements in the rocker arm causing changes in said average angle of attack.

4. An aircraft according to claim 3 wherein said rocker arm is connected to both of the wings, and when a movement in the rocker arm positively changes the average angle of attack on one of the wings it simultaneously negatively changes the angle of attack on the other wing.

5. An aircraft according to claim 3 where said left and right wings are flapping wings, said flapping wings have a leading edge, a trailing edge, a tip and an inner part, the flapping wings each comprise a stiff beam near the leading edge, said stiff beams being connected to a flapping mechanism adapted to flap the wings up and down, a major part of the wings consist of flexible skin attached to said beams, wherein said rocker arm having a left connecting point being connected to said inner part of the left wing and a right connecting point being connected to said inner part of the right wing, the rocker arm is pivotably connected to the aircraft and it is furthermore adapted to move, teeter up and down, in response to said force, said force is provided by an actuator in response to an input signal or by a manual input, the force moves said rocker arm in a first direction in response to an input indicating a left turn and the force moves said rocker arm in a second direction in response to an input indicating a right turn, and a movement of the rocker arm in said first direction moves said trailing edge on the left wing down and said trailing edge on the right wing up, and a movement of the rocker arm in said second direction moves said trailing edge on the left wing up and said trailing edge on the right wing down.

6. An aircraft according to claim 2 wherein said force is provided by an actuator in response to a control signal.

7. An aircraft according to claim 6 wherein said actuator comprises an electric motor, a magnetic coil or a piezoelectric element.

8. An aircraft according to claim 2 where said left and right wings each have a trailing edge and an inner part, wherein said moveable linkage comprises one or more connecting points, at least one of the wings is in said wing's inner part attached to one of the said connecting points, said force is provided by an actuator in response to an input signal or by a manual input, the force moves said linkage in a first direction in response to an input indicating a left turn and the force moves said linkage in a second direction in response to an input indicating a right turn, and a movement of the linkage in said first direction moves said trailing edge on the left wing down and said trailing edge on the right wing up, and a movement of the linkage in said second direction moves said trailing edge on the left wing up and said trailing edge on the right wing down.

9. An aircraft according to claim 1 comprising additional left and right wings, said additional wings being fixed wings, pivotably mounted wings or flapping wings.

10. An aircraft according to claim 1 wherein said aircraft is a flying toy.

11. An aircraft comprising a left wing having a first average incidence angle, a right wing having a second average incidence angle and a control means adapted to receive an input for controlling said aircraft in a desired direction by utilizing differential drag acting on said wings, wherein said control means is operatively connected to a part of one or both of the wings and said control means is arranged to move said part in order to change at least one of said first and second average incidence angle, and increasing at least one of said first and second average incidence angles increases the drag acting on the respective wings and decreasing at least one of said first and second average incidence angle decreases the drag acting on the respective wings, and if the control means receives an input indicating a left turn said control means causes at least one of increasing said first average incidence angle and decreasing said second average incidence angle, and if the control means receives an input indicating a right turn said control means causes at least one of decreasing said first average incidence angle and increasing said second average incidence angle, whereby, changing the average incidence angle on at least one of the wings to a state where said first and second incidence angles are different will result in different drag acting on the respective wings, thereby turning the aircraft in the direction of the wing having the greater drag.

* * * * *